US005530534A

United States Patent [19]

Dalal

[11] Patent Number: 5,530,534

[45] Date of Patent: Jun. 25, 1996

[54] TRANSFUSING ASSEMBLY

[75] Inventor: Edul N. Dalal, Webster, N.Y.

[73] Assignee: Xerox Corporation, Stamford, Conn.

[21] Appl. No.: 497,567

[22] Filed: Jun. 30, 1995

[51] Int. Cl.[6] ..... G03G 15/16; G03G 15/20

[52] U.S. Cl. ..... 355/271; 355/279; 355/285

[58] Field of Search ..... 355/279, 275, 355/271, 256, 285

[56] References Cited

U.S. PATENT DOCUMENTS

| | | | |
|---|---|---|---|
| 3,955,530 | 5/1976 | Knechtel | 118/60 |
| 3,957,367 | 5/1976 | Goel | 355/281 |
| 4,348,098 | 9/1982 | Koizumi | 355/274 |
| 4,515,460 | 5/1985 | Knechtel | 355/327 |
| 4,542,978 | 9/1985 | Tarumi et al. | 355/279 |
| 4,935,788 | 6/1990 | Fantuzzo et al. | 355/326 R |
| 5,098,856 | 2/1992 | Landa et al. | 355/279 |
| 5,253,021 | 10/1993 | Aslam et al. | 355/271 |
| 5,254,424 | 10/1993 | Felder | 430/112 |
| 5,352,558 | 10/1994 | Simms et al. | 430/125 |
| 5,355,201 | 10/1994 | Hwang | 355/256 |
| 5,361,126 | 11/1994 | Loonen et al. | 355/279 |
| 5,418,105 | 5/1995 | Wayman et al. . | |

*Primary Examiner*—Joan H. Pendegrass
*Assistant Examiner*—Sophia S. Chen
*Attorney, Agent, or Firm*—John M. Kelly

[57] ABSTRACT

Printing machines which incorporate a transfusing station having a transfusing member with a resistive heater layer. The transfusing station is entrained between at least two electrically conductive contact members, such as rollers, which electrically contact the heater layer. An electrical source sends current through the conductive rollers and the heater layer, heating that layer. A backup roller adjacent the transfusing member and the conductive rollers induces pressure on substrates which pass between the backup roller and the transfusing member. The combination of heat from the heatier layer and pressure induced by the backup roller causes any toner image on the transfusing member to fuse onto the substrate.

10 Claims, 2 Drawing Sheets

TRANSFUSING ASSEMBLY

FIELD OF THE INVENTION

This invention relates to electrophotographic printing machines which use an intermediate transfer member in the fusing process.

BACKGROUND OF THE INVENTION

Electrophotographic marking is a well known and commonly used method of copying or printing original documents. Electrophotographic marking is typically performed by exposing a light image of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after an intermediate transfer step, onto a substrate such as a sheet of paper. The transferred toner powder image is then fused to the substrate using heat and/or pressure. The surface of the photoreceptor is then cleaned of residual developing material and recharged in preparation for the creation of another image.

The foregoing generally describes a typical black and white electrophotographic printing machine. Electrophotographic printing can also produce color images by repeating the above process for each color of toner that is used to make the color image. For example, the charged photoconductive surface may be exposed to a light image which represents a first color, say cyan. The resultant electrostatic latent image can then be developed with cyan toner particles to produce a cyan toner image which is subsequently transferred and fused onto a substrate. The process can then be repeated for a second color, say magenta, then a third color, say yellow, and finally a fourth color, say black. If the toner particles are placed in a superimposed registration the desired composite color image is formed on the substrate.

The color printing process described above superimposes the various color toner powder images directly onto a substrate. Another electrophotographic color printing process uses an intermediate transfer member. In systems which use an intermediate transfer member successive toner images are transferred in superimposed registration from the photoreceptor onto the intermediate transfer member. Only after the composite toner image is formed on the intermediate transfer member is that image transferred and fused onto the substrate.

The most common developing materials are dry powder toners. Dry powder developers are typically comprised of not only toner particles but also of carrier granules. The toner particles triboelectrically adhere to the carrier granules until the toner particles are attracted onto the latent image. An alternative to dry powder developing materials are liquid developers.

Liquid developers, also referred to as liquid inks, have a liquid carrier into which toner particles are dispersed. When developing with liquid developers both the toner particles and the liquid carrier are advanced into contact with the electrostatic latent image. The liquid carrier is then removed by blotting, evaporation, or by some other means, leaving the toner particles behind.

Intermediate transfer members can also be used in the fusing process. Intermediate transfer members which are used in fusing are referred to herein as transfusing members, and the combined processes of transferring and fusing is called transfusing. Transfusing is highly desirable since the size and cost of transfusing printing machines can be less than comparable printing machines which have separate transfer and fusing stations. Other advantages such as improved image quality can also be obtained by transfusing. Transfusing members are usually pinched between one or more contact rollers and a backup roller such that a fusing pressure is created between the nip of the backup roller and the transfusing member. During fusing a substrate passes between the backup roller and the transfusing member and heat is applied to the toner image. The combination of heat and pressure causes the toner image to fuse onto the substrate. Transfusing may be done without heat, but the resulting quality is usually inferior.

One potential problem with transfusing members is that the transfusing member needs to be hot to provide high-quality fusing. That heat can damage the photoreceptor and can interfere with the transfer process.

Additionally, it is desirable that the power consumed during fusing be low. Meeting the conflicting requirements of fusing without damaging the photoreceptor while using little power is difficult. Thus, energy efficient transfusing stations, and printing machines which use such transfusing stations, which reduce the heating of the photoreceptor are highly desirable.

Various approaches have been devised to produce multicolor color copies. The following U.S. patents may be useful references:

U.S. Pat. No. 3,392,667
Patentee: Cassel et al.
Issued: Jul. 16, 1968

U.S. Pat. No. 3,399,611
Patentee: Lusher
Issued: Sep. 3, 1968

U.S. Pat. No. 3,955,530
Patentee: Knechtel
Issued: May 11, 1976

U.S. Pat. No. 3,957,367
Patentee: Goel
Issued: May 18, 1976

U.S. Pat. No. 4,348,098
Patentee: Koizumi
Issued: Sep. 7, 1982

U.S. Pat. No. 4,515,460
Patentee: Knechtel
Issued: May 7, 1985

U.S. Pat. No. 4,588,279
Patentee: Fukuchi et al.
Issued: May 13, 1986

U.S. Pat. No. 4,935,788
Patentee: Fantuzzo et al
Issued Jun. 19, 1990

U.S. Pat. No. 5,254,424
Patentee: Felder
Issued: Oct. 19, 1993

U.S. Pat. No. 5,352,558

Patentee: Simms et al
Issued: Oct. 4, 1994

U.S. Pat. No. 5,355,201
Patentee: Hwang
Issued: Oct. 11, 1994

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,399,611 describes four image transfer stations disposed about the periphery of a rotatable cylindrical metal drum. Each image transfer station is basically the same and includes a photoconductive drum charged by a charging wire and then rotated into alignment with an image exposure station to record a latent image thereon. Powder particles are then cascaded across the latent image to develop it. The powder image is then transferred to the surface of the metal drum. The powder particles are of different colors. The completed powder image is transferred from the metal drum to an article to be decorated.

U.S. Pat. No. 3,955,530 discloses a color image forming electrophotographic printing machine. Different color developers are used to develop the latent images recorded on the photoconductive drum. Each developed image is sequentially transferred to an intermediate transfer drum. A cleaning blade is used to clean the photoconductive drum between developing different color developers. The complete image is transferred from the intermediate drum to a copy sheet.

U.S. Pat. No. 3,957,367 describes a color electrophotographic printing machine in which successive different color toner powder images are transferred from a photoconductive drum to an intermediate roller, in superimposed registration with one another, to an intermediary roller. The multilayered toner powder image is fused on the intermediary roller and transferred to the copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,515,460 describes a color electrophotographic copying machine in which four developer units develop four latent images recorded on a photoconductive drum with different color toner particles. The different color toner powder images are transferred to an endless belt in superimposed registration with one another. The resultant toner powder image is then transferred from the belt to a copy sheet.

U.S. Pat. No. 4,588,279 discloses an intermediate transfer member that has a dry toner image transferred thereto from the surface of a toner image forming member. The toner image is then transferred from the transfer member to a recording paper.

U.S. Pat. No. 4,935,788 discloses a multicolor printing system that uses liquid developing and an intermediate member.

U.S. Pat. No. 5,254,424 discloses a liquid developer material which contains toner particles formed from a urethane modified polyester.

U.S. Pat. No. 5,352,558 discloses a liquid developer system which uses an absorbing belt.

U.S. Pat. No. 5,355,201 discloses an apparatus for developing an electrostatic latent image with liquid toner.

SUMMARY OF THE INVENTION

The present invention provides for electrophotographic printing machines comprised of transfusing stations having resistively heated transfusing members. Printing machines according to the principles of the present invention include a photoreceptor having a photoconductive surface, a charging station for charging that photoconductive surface to a predetermined potential, at least one exposure station for exposing the photoconductive surface to produce an electrostatic latent image on the photoconductive surface, at least one developing station for depositing developing material on that latent image to produce a toner image on the photoconductive surface, and a transfusing station. The transfusing station receives the toner image on a transfusing member which has a resistive heating layer. In electrical contact with the heating layers are first and second electrical contacts, which, for example, may be electrically conductive contact rollers. Those contacts are in electrical contact with an electrical source which applies electrical current through the first and second contacts and through the heating layer such that the heating layer heats the toner image. The transfusing station further includes a backup roller which is adjacent the transfusing member. The backup roller induces pressure on substrates which pass between the backup roller and the transfusing member. The combination of heat and pressure causes the toner image to fuse into the substrate.

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENT

Figure 1:
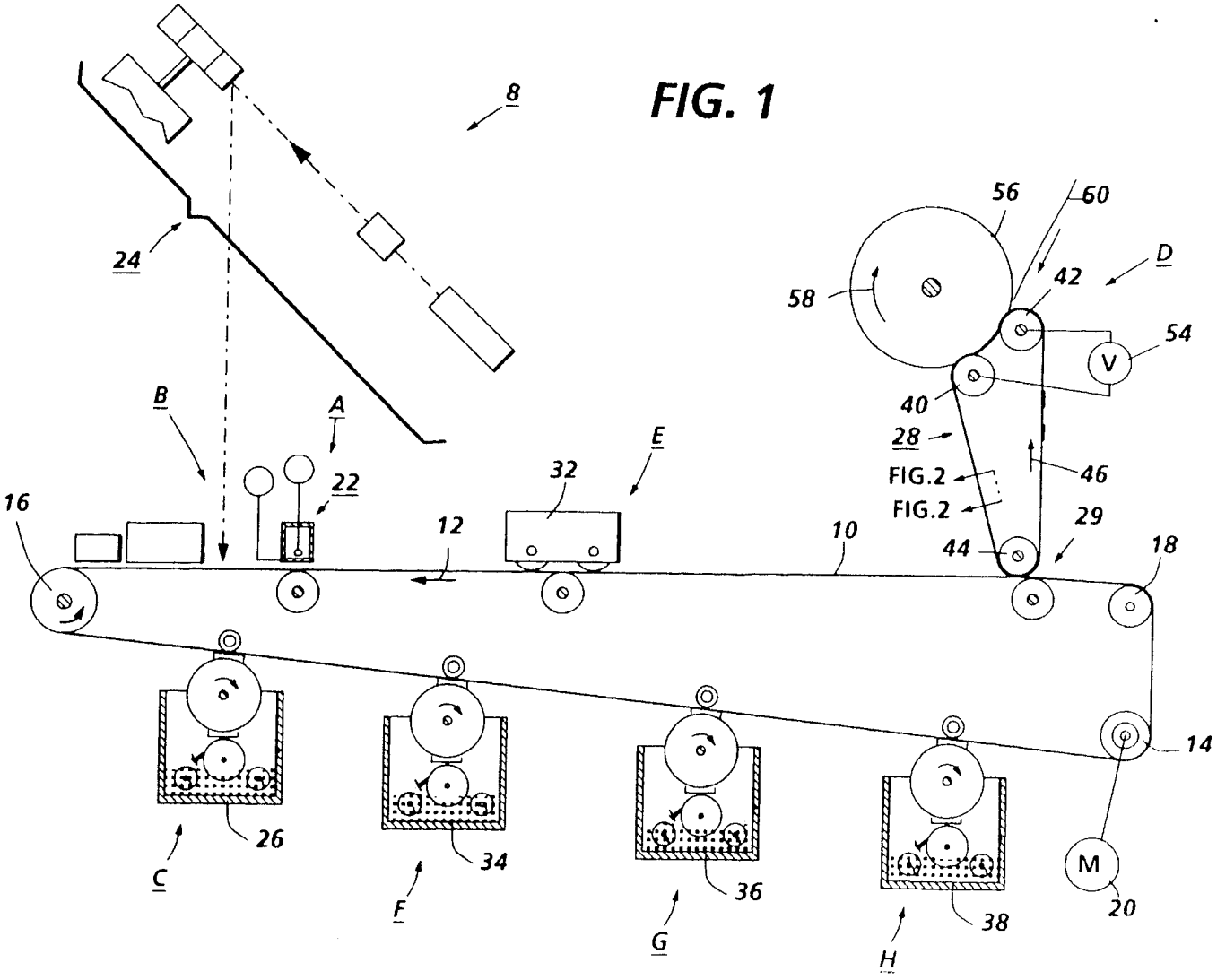
FIG. 1 schematically depicts an electrophotographic printing machine which incorporates the principles of the present invention.

FIG. 1 illustrates an electrophotographic printing machine 8 that copies an original document. Although the principles of the present invention are well suited for use in such electrophotographic copiers, they are also well suited for use in other printing devices, including electrophotographic printers. Therefore it should be understood that the present invention is not limited to the particular embodiment illustrated in FIG. 1 or to the particular application shown therein.

The printing machine 8 includes a charge retentive surface in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described process stations. For convenience, a single section of the photoreceptor, referred to as the image area, is identified. The image area is that part of the photoreceptor which is operated on by the various process stations to produce a developed image. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

After passing through the charging station A the now charged image area passes to an exposure station B. At exposure station B the charged image area is exposed to the output of a laser based output scanning device 24 which illuminates the image area with a light representation of a first color image, say black. That light representation discharges some parts of the image area so as to create an electrostatic latent image.

After passing through the exposure station B, the now exposed image area passes through a first development station C. The first development station C advances negatively charged development material 26, which is comprised of black toner particles, onto the image area. The development material is attracted to the less negative sections of the image area and repelled by the more negative sections. The result is a first toner image on the image area. While the development material 26, and all of the subsequently described development materials, could be either powder or liquid, the principles of the present invention are particularly useful with liquid development materials. If the development material is a powder toner then the toner image is substantially pure toner particles. However, if the development material is liquid the toner image is comprised of toner particles and a liquid carrier.

After passing through the first development station C the image area is advanced to a transfusing station D. That transfusing station includes a positively charged transfusing member 28 which may be a belt as illustrated in FIG. 1 or a drum. As the image area passes by the transfusing member the first toner image is transferred onto the transfusing member at the nip 29. The operation of the transfusing station D is described subsequently.

After the first toner image is transferred to the transfusing member 28 the image area passes to a cleaning station E. The cleaning station E removes any residual development material from the photoreceptor 10 using a cleaning brush contained in a housing 32.

After passing through the cleaning station E the image area repeats the charge-expose-develop-transfer sequence for a second color of developer material (say magenta). Charging station A recharges the image area and exposure station B illuminates the recharged image area with a light representation of a second color image (magenta) to create a second electrostatic latent image. The image area then advances to a second development station F which deposits a second negatively charged development material 34, which is comprised of magenta toner particles, onto the image area so as to create a second toner image. The image area and its second toner image is then advanced to the transfusing station D where the second toner image is transferred onto the transfusing member 28.

The image area is again cleaned by the cleaning station E. The charge-expose-develop-transfer-clean sequence is then repeated for a third color (say yellow) of development material 36 using development station G, and then for a fourth color 38 (say cyan) of development material using development station H.

The construction and operation of the transfusing station D will now be described in detail. The transfusing member 28 is entrained between a first conductive roller 40, a second conductive roller 42, and a stripper roller 44. The stripper roller is rotated by a motor, which is not shown, such that the transfusing member rotates in the direction 46 in synchronism with the movement of the photoreceptor 10. The synchronism is such that the various toner images are registered with each other after they are transferred onto the transfusing member 28.

Figure 2:
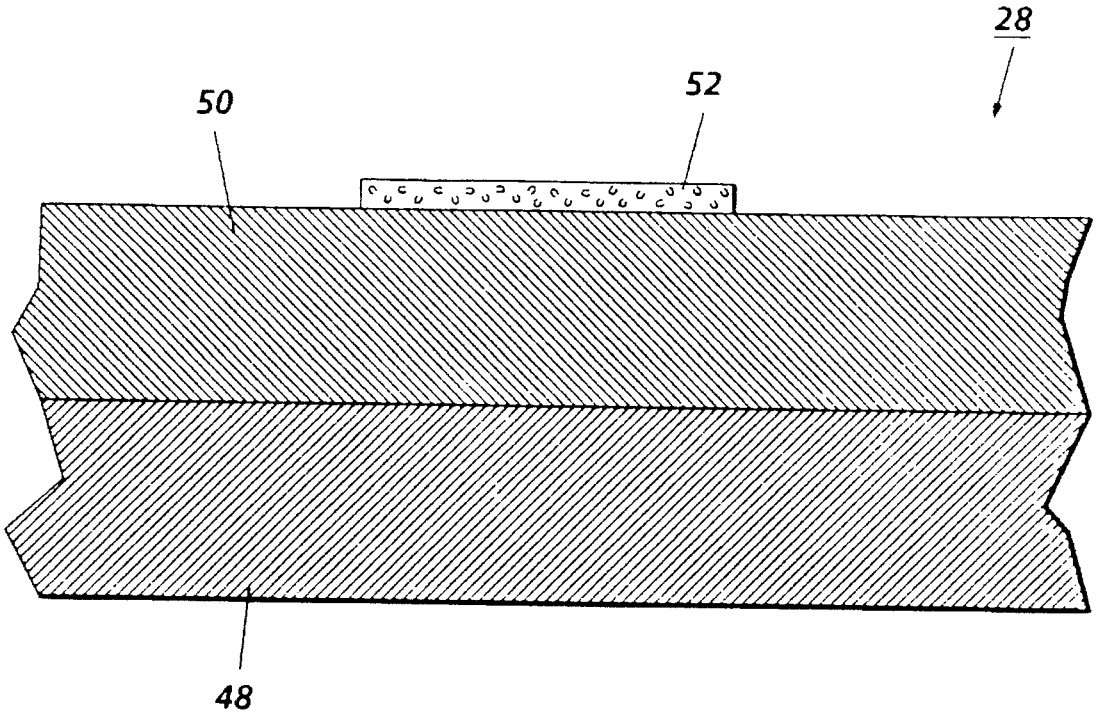
FIG. 2 shows the composition profile of the transfusing member taken along the lines 2—2 of FIG. 1.

The construction of the transfusing member is shown in more detail in FIG. 2, which is a blow up of the section 2—2 in FIG. 1. As shown in FIG. 2, the transfusing member 28 is a seamless assembly of two layers, an electrically resistive heater layer 48 and a release layer 50. The heater layer 48 is in electrical contact with the first conductive roller 40 and with the second conductive roller 42. As shown in FIG. 2, the toner image layers, represented by the element 52 in FIG. 2, are on the release layer 50. An assembly similar to the transfusing member 28 is taught in U.S. patent application Ser. No. 08/169,802, entitled, "Apparatus and Method for Fusing Toner Images on Transparent Substrates." That patent application is hereby incorporated by reference. However, that assembly is used only for fusing.

Referring once more to FIG. 1, the transfusing assembly D also includes a source 54 of electrical power. The source supplies electrical current which passes through the first conductive roller 40, the heater layer 48, and the second conductive roller 42. That current causes the heater layer to heat up, which in turn heats the toner image layers on the release layer 50. The use of a seamless belt construction is important because a seamed belt would be subject to arcing and wear at each make and break with the contact rollers.

By locating the first and second conductive rollers near each other and far from the stripper roller 44, most of the electrical current from the source 54 will flow through the section of the heater layer 48 which is between the first and second conductive rollers. This arrangement will cause much more heat to be generated between the first and second conductive rollers than in other parts of the transfusing member. This is beneficial since the heated section of the transfusing member will have time to cool before another toner image is deposited on the transfusing member. Furthermore, the transfusing member, being in the form of a thin belt, can be made with very low thermal mass. It can thus be heated extremely rapidly to operating temperature and can cool down rapidly as well. This means that the electrical power from the source 54 can be switched on just when an image is to be transfused, leading to reduced overall power consumption because standby power is not required. Moreover, because of rapid cool-down the transfusing member will be relatively cool when it contacts the photoreceptor, minimizing photoreceptor damage.

Still referring to FIG. 1, the transfusing station D also includes a backup roller 56 which rotates in the direction 58. The backup roller is beneficially located adjacent the first and second conductive rollers and the section of the transfusing member between those rollers. The backup roller cooperates with the conductive rollers and with the transfusing member to form a fusing zone. When a substrate 60 passes through the fusing zone the heated composite toner image contacts the substrate as the substrate passes between the backup roller and the transfusing member. The combination of heat and pressure fuses the composite toner image onto the substrate.

It is to be understood that while the figures and the above description illustrate the present invention, they are exemplary only. Others who are skilled in the applicable arts will recognize numerous modifications and adaptations of the illustrated embodiments which will remain within the principles of the present invention. For example, while the described embodiment uses electrically conductive rollers which contact the heating layer, other means of making electrical contact with the heating layer, such as by using brushes, may also be used. Therefore, the present invention is to be limited only by the appended claims.

What is claimed:

1. A printing machine comprising:

a photoreceptor having a photoconductive surface;

a charging station for charging said photoconductive surface to a predetermined potential;

an exposure station for exposing said photoconductive surface to produce a first electrostatic latent images on said photoconductive surface;

a first developing station for depositing developing material on said first electrostatic latent image so as to produce a first toner image on said photoconductive surface;

a transfusing member for receiving said first toner image from said photoconductive surface, said transfusing member having a heating layer comprised of a resistive material;

an electrically conductive first contact member contacting said heating layer at a first location;

an electrically conductive second contact member contacting said heating layer at a second location;

an electrical source for sending electrical current through said first contact roller, through said heating layer, and through said second contact roller such that said heating layer heats said first toner image; and a backup roller adjacent said transfusing member, said backup roller for inducing pressure on a substrate when said substrate passes between said backup roller and said transfusing member.

2. The printing machine according to claim 1 wherein said developing material is a liquid developing material.

3. The printing machine according to claim 1 wherein said developing material is a dry developing material.

4. The printing machine according to claim 1, further including:

an exposure station for exposing said photoconductive surface to produce a second electrostatic latent images on said photoconductive surface; and a second developing station for depositing developing material on said second electrostatic latent image so as to produce a second toner image on said photoconductive surface;

wherein said second toner image is transferred onto said transfusing member in superimposed registration with said first toner image, and wherein both said first and second toner images are fused onto a substrate.

5. A method of transferring an image from a photoconductive surface onto a substrate, said method comprising the steps of forming a toner image on a photoconductive surface; transferring that toner image onto a transfusing member having a heating layer;

heating said heating layer by passing an electrical current through said heating layer;

locating a substrate adjacent the toner image on said transfusing member; and applying pressure to said substrate such that said heated toner image fuses to said substrate.

6. A transfuser member comprised of a material that heats and cools rapidly so as to enable the transfuser belt to be heated in a localized regions when transfusing an image onto a substrate and so as to be at substantially room temperature when receiving an image.

7. A printing machine comprising:

a photoreceptor having a photoconductive surface;

a charging station for charging said photoconductive surface to a predetermined potential;

an exposure station for exposing said photoconductive surface to produce a first electrostatic latent images on said photoconductive surface;

a first developing station for depositing developing material on said first electrostatic latent image so as to produce a first toner image on said photoconductive surface;

a transfusing member for receiving said first toner image from said photoconductive surface and for transfusing said received image onto a substrate, said transfusing member comprised of a material that heats and cools rapidly so as to enable the transfusing member to be heated in a localized region when transfusing an image onto a substrate and so as to be at substantially room temperature when receiving said first toner image, said transfusing member having a resistive heating layer;

an electrically conductive first contact member contacting said heating layer at a first location;

an electrically conductive second contact member contacting said heating layer at a second location;

an electrical source for sending electrical current through said first contact member, through said heating layer, and through said second contact member such that said heating layer heats said first toner image; and a backup roller adjacent said transfusing member, said backup roller for inducing pressure on a substrate when said substrate passes between said backup roller and said transfusing member.

8. The printing machine according to claim 7 wherein said developing material is a liquid developing material.

9. The printing machine according to claim 7 wherein said developing material is a dry developing material.

10. The printing machine according to claim 7, further including:

an exposure station for exposing said photoconductive surface to produce a second electrostatic latent images on said photoconductive surface; and a second developing station for depositing developing material on said second electrostatic latent image so as to produce a second toner image on said photoconductive surface;

wherein said second toner image is transferred onto said transfusing member in superimposed registration with said first toner image, and wherein both said first and second toner images are fused onto a substrate.

* * * * *